US007954805B2

(12) United States Patent
Mitsuya et al.

(10) Patent No.: US 7,954,805 B2
(45) Date of Patent: Jun. 7, 2011

(54) MAIL FEEDING DEVICE

(75) Inventors: Yusuke Mitsuya, Yokohama (JP); Yoshihiko Naruoka, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 77 days.

(21) Appl. No.: 12/388,007

(22) Filed: Feb. 18, 2009

(65) Prior Publication Data

US 2009/0309292 A1 Dec. 17, 2009

(30) Foreign Application Priority Data

Jun. 11, 2008 (JP) ..... 2008-153037

(51) Int. Cl.
*B65H 5/08* (2006.01)

(52) U.S. Cl. ..... 271/11; 271/10.03; 271/104

(58) Field of Classification Search ..... 271/11, 271/10.03, 104

See application file for complete search history.

(56) References Cited

U.S. PATENT DOCUMENTS

| | | | | |
|---|---|---|---|---|
| 5,391,051 | A | 2/1995 | Sabatier et al. | |
| 6,186,491 | B1 * | 2/2001 | Tomiyama et al. | 271/12 |
| 6,575,450 | B2 * | 6/2003 | Blackwell et al. | 271/11 |
| 2007/0262512 | A1 | 11/2007 | Watanabe et al. | |

FOREIGN PATENT DOCUMENTS

JP 2000-109229 4/2000

OTHER PUBLICATIONS

Korean Office Action dated Feb. 11, 2011.

* cited by examiner

*Primary Examiner* — Michael C McCullough
(74) *Attorney, Agent, or Firm* — Pillsbury Winthrop Shaw Pittman, LLP

(57) ABSTRACT

A feeding device for feeding each of accumulated mail items P onto a conveyance path includes a pickup belt which runs along a pickup position, and a negative-pressure chamber opposing the pickup position with the pickup belt interposed therebetween. When each mail item is picked up from the pickup position and reaches a nip between conveyance belts, air is introduced into the negative-pressure chamber to eliminate negative pressure therein.

5 Claims, 7 Drawing Sheets

MAIL FEEDING DEVICE

CROSS-REFERENCE TO RELATED APPLICATIONS

This application is based upon and claims the benefit of priority from prior Japanese Patent Application No. 2008-153037, filed Jun. 11, 2008, the entire contents of which are incorporated herein by reference.

BACKGROUND OF THE INVENTION

1. Field of the Invention

The present invention relates to a mail feeding device for feeding a plurality of accumulated mail items one by one.

2. Description of the Related Art

A mail feeding device is known in which a belt with holes is run along mail items to hold them one by one, using a suction nozzle provided at the reverse side of the belt, thereby sequentially picking up them (see, for example, U.S. Pat. No. 5,391,051). In this device, a solenoid valve for executing on/off control of negative pressure is provided between a vacuum tank and the suction nozzle.

In this structure, to pick up each mail item, the belt is run, the solenoid valve is opened, and the suction nozzle is operated to hold each mail item on the belt using a suction force. Further, to continuously feed mail items, the solenoid valve is closed regularly in accordance with the feeding timing of each mail item, thereby providing gaps between subsequently fed mail items.

However, in the above structure, even if the solenoid valve is closed to stop suction by the suction nozzle, negative pressure applied to a mail item cannot quickly be eliminated where the mail item is held by the belt by a suction force. Accordingly, even if the on/off cycle of the solenoid valve is shortened to feed mail items at high speed, high-speed feeding of mail items cannot be realized since negative pressure applied to the mail items cannot quickly be eliminated.

BRIEF SUMMARY OF THE INVENTION

It is an object of the invention to provide a mail feeding device that can pick up accumulated mail items one by one at desired timing.

To attain the object, a mail feeding device according to an embodiment of the invention comprises: a pickup member including suction holes formed therein, and configured to run along one of accumulated mail items in a direction in which the one mail item is picked up, the one mail item being accumulated earliest and positioned at a pickup position; a negative-pressure chamber including an opening which opposes the pickup position with the pickup member interposed therebetween, the negative-pressure chamber applying negative pressure, via the suction holes, to the one mail item positioned at the pickup position, thereby making the one mail item to be held by the pickup member; drawing means which draw air from the negative-pressure chamber; a pressure adjustment unit configured to introduce air into the negative-pressure chamber, from which air was drawn by the drawing means, to increase internal pressure of the negative-pressure chamber toward atmospheric pressure; a conveyance section configured to receive the one mail item held on the pickup member by the negative pressure and picked up from the pickup position, and to convey the picked up mail item; a detector section configured to detect whether the picked up mail item has been transferred to the conveyance path; and a controller configured to cause the pressure adjustment unit to increase the internal pressure of the negative-pressure chamber toward atmospheric pressure after the detector section detects that the picked up mail item has been transferred to the conveyance path.

In the above-described invention, since air is introduced into the negative-pressure chamber to positively eliminate negative pressure therein after a mail item picked up from the pickup position, held on the pickup member by the negative pressure of the negative-pressure chamber and picked up from the pickup position, is transferred to the conveyance section, subsequent mail items, which have been picked up unintentionally simultaneously with the first-mentioned mail item, are prevented from being rendered to the negative pressure of the negative-pressure chamber, whereby accumulated mail items can be quickly picked up one by one at desired timing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the invention will be described in detail with reference to the accompanying drawings.

Figure 1:
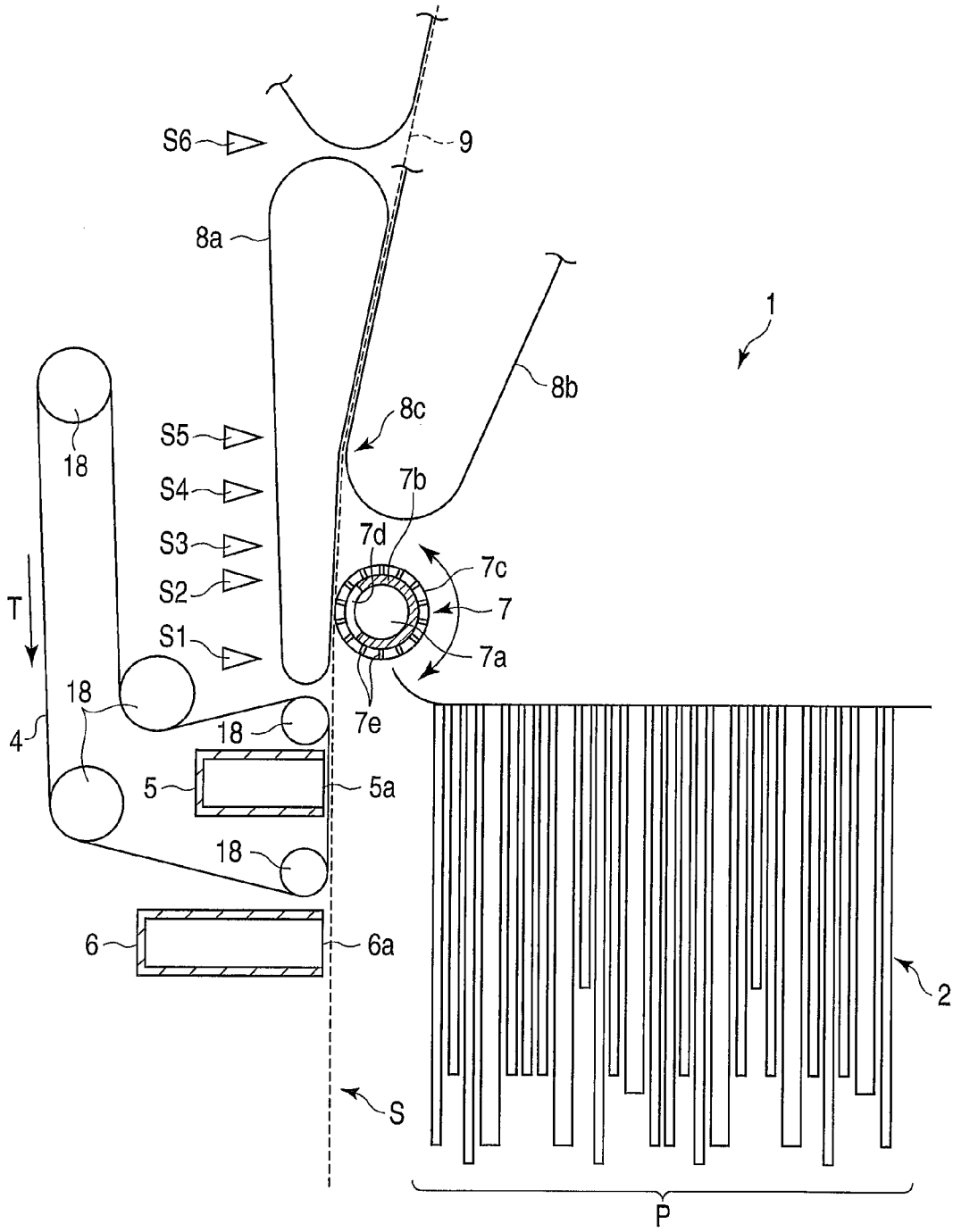
FIG. 1 is a schematic view illustrating a mail feeding device according to embodiments of the invention.
Figure 2:
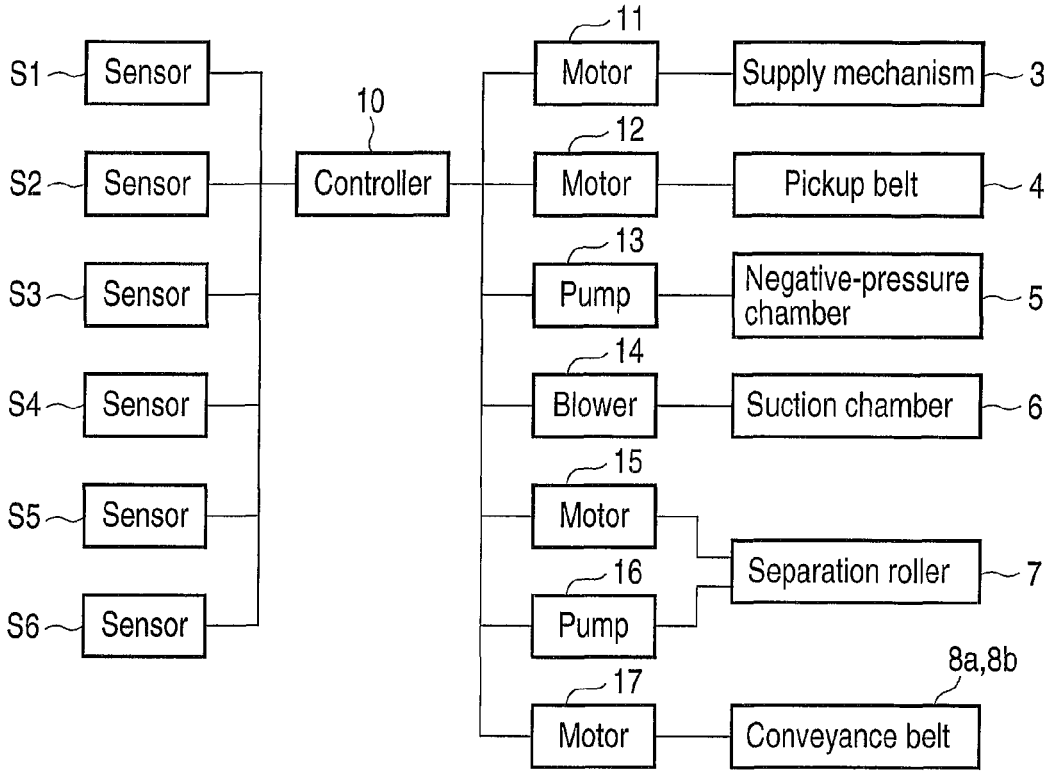
FIG. 2 is a block diagram illustrating a control system for controlling the operation of the mail feeding device shown in FIG. 1.

FIG. 1 is a schematic plan view taken from above and illustrating a mail feeding device 1 (hereinafter, "feeding device 1") according to the embodiments of the invention. FIG. 2 is a block diagram illustrating a control system for controlling the operation of the feeding device 1.

The feeding device 1 comprises an inlet unit 2, a supply mechanism 3, a pickup belt 4 (pickup member), a negative-pressure chamber 5, a suction chamber 6, a separation roller 7, conveyance belts 8*a* and 8*b*, sensors S1 to S6, and a controller 10 for controlling the operation of the entire feeding device. The conveyance belts 8*a* and 8*b* and a motor 17, described later, cooperate to function as a conveyance section in the invention. The sensor S5 functions as a detection unit in the invention. A pump 16, described later, connected to the separation roller 7 also functions as an air supply unit in the invention.

The controller 10 is connected to the sensors S1 to S6, a motor 11 for driving a floor belt and a backup belt (not shown) incorporated in the supply mechanism 3, a motor 12 for running the pickup belt 4 in the direction indicated by arrow T, a pump 13 (drawing means) for drawing air from the negative-pressure chamber 5, a pump 7 for causing negative pressure to occur around the separation roller 7, and a motor 17 for running conveyance belts 8*a* and 8*b*.

The inlet unit 2 receives a plurality of mail items P in an accumulated and upright state. The mail items P received in the inlet unit 2 are moved to one side of the unit 2 (leftward in FIG. 1) and then to a pickup position S one by one by the supply mechanism 3. Whenever each mail item P supplied to the pickup position S is picked up, the supply mechanism 3 operates to guide, to the pickup position S, a subsequent one of the mail items P accumulated at the one side of the unit 2.

The pickup belt 4 is wound on a plurality of pulleys 18 and made to run endlessly. Part of the pickup belt 4 is brought into contact with each mail item P guided to the pickup position S, and made to run at a constant rate in a direction parallel to the surface of each mail item P, i.e., in the pickup direction T (upward in FIG. 1). The negative-pressure chamber 5 is provided inside the pickup belt 4, opposing the pickup position S with the pickup belt 4 interposed therebetween.

Figure 3:
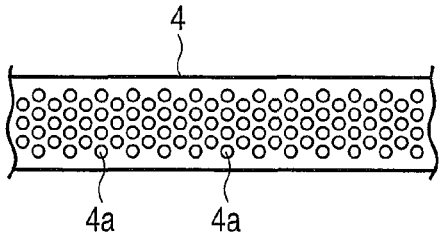
FIG. 3 is a fragmentary enlarged view illustrating part of a pickup belt incorporated in the mail feeding device of FIG. 1.

As shown in FIG. 3, the pickup belt 4 has a plurality of suction holes 4*a* formed therein. The negative-pressure chamber 5 has an opening 5*a* opposing the reverse side of the pickup belt 4. In this structure, when air is drawn from the negative-pressure chamber 5 by running the pickup belt 4, negative pressure is applied to each mail item P positioned at the pickup position S through the opening 5*a* of the negative-pressure chamber 5 and the suction holes 4*a* of the pickup belt 4, thereby holding each mail item P on the pickup belt 4 by negative pressure. Thus, each mail item P held by the pickup belt 4 is picked up from the pickup position S in accordance with the running of the pickup belt 4.

Each mail item P picked up from the pickup position S is conveyed upward in FIG. 1 via a conveyance path 9, and transferred to the conveyance section 8. The sensors S1 to S6 provided along the conveyance path 9 are transmissive optical sensors (only one of the components of each sensor is shown). These sensors detect whether each mail item P crosses their optical axes (when it crosses their optical axes, they output a signal indicating "darkness"), and detect whether each mail item P does not exist on the optical axes (when it does not exist on their optical axes, they output a signal indicating "brightness"). Namely, the sensors S1 to S6 detect the leading and rear ends of each mail item P with respect to the direction of conveyance.

The suction chamber 6 is provided upstream (at the lower position in FIG. 1) of the pickup belt 4 with respect to the direction in which each mail item P is picked up, and has an opening 6*a* opposing the pickup position S. When a blower 14 is operated, air is drawn through the opening 6*a* of the suction chamber 6, thereby causing an air flow at the pickup position S. The air flow functions to quickly draw each mail item P received in the inlet unit 2 and fed to the above-mentioned one side (left side) of the inlet unit 2.

The separation roller 7 is provided downstream of the pickup position S with respect to the mail pickup direction, and opposes the pickup belt 4 with the conveyance path 9 interposed therebetween. The separation roller 7 includes a substantially cylindrical core 7*b* with a chamber 7*a* defined therein, and a substantially cylindrical sleeve 7*c* rotatably provided on the outer periphery of the core 7*b*. The core 7*b* has an opening 7*d* fixedly opening to the conveyance path 9. The sleeve 9*c* has a plurality of suction holes 7*e*. With this structure, when the pump 16 is operated to draw air from the chamber 7*a* of the core 7*b*, negative pressure occurs at the periphery of the separation roller 7 via the suction holes 7*e* of the sleeve 7*c* that rotates around the core 7*b*.

Namely, by applying, to the sleeve 7*c*, separation torque that exerts in a direction opposite to the mail pickup direction, using the motor 15, and causing negative pressure around the outer periphery of the sleeve 7*c*, using the pump 16, a few mail items P picked up unintentionally simultaneously with a leading mail item P when the leading mail item is picked up from the pickup position S can be separated from the leading mail item.

The conveyance belt 8*a*, an endless belt, is tensioned (at the left side in FIG. 1), opposing the separation roller 7 with the conveyance path 9 interposed therebetween. Further, the conveyance belt 8*b* is tensioned, opposing the conveyance belt 8*a* with the conveyance path 9 interposed therebetween. Thus, the conveyance path 9 located downstream of the separation roller 7 is defined between the two conveyance belts 8*a* and 8*b*. The front end of each mail item P picked up from the pickup position S is nipped by the nip 8*c* of the conveyance belts 8*a* and 8*b*, and conveyed to the downstream side by the conveyance belts 8*a* and 8*b* (conveyance section).

A description will now be given of the operation of feeding, one by one onto the conveyance path 9, a plurality of mail items P received in the inlet unit 2.

When a plurality of mail items P are fed from the inlet unit 2 to the feeding device 1, they are sequentially supplied by the supply mechanism 3 to the pickup position S, and are drawn by the pickup belt 4 and fed onto the conveyance path 9. The mail items P conveyed through the conveyance path 9 are monitored in conveyance position and state by the sensors S1 to S6.

When each mail item P is picked up, the pump 13 is operated to draw air from the negative-pressure chamber 5, thereby generating negative pressure on the surface of the pickup belt 4. Further, an air flow directed to the pickup position S is always applied by the suction chamber 6 to the mail item P earliest accumulated in the inlet unit 2 (i.e., the leftmost one in FIG. 1). Namely, the earliest accumulated mail item is quickly positioned at the pickup position, and picked up by the pickup belt 4 by a suction force.

The mail item P picked up from the pickup position S is guided to the nip 8*c* of the conveyance belts 8*a* and 8*b*, and then guided to a further downstream side, with the front end of the mail item nipped by the nip 8*c*. The fact that the picked mail item P has reached the nip 8*c* is detected when the output of the sensor S5 is changed from "brightness" to "darkness." At this time, the running rate of the conveyance belts 8*a* and 8*b* is set to a value slightly higher than that of the pickup belt 4, which means that the mail item P is pulled out by the conveyance belts 8*a* and 8*b*.

When one or more mail items P are picked up simultaneously with a mail item P firstly fed to the pickup position S, the former mail items P are separated from the latter one by the separation roller 7. At this time, negative pressure is produced on the periphery of the separation roller 7, and separation torque is exerted on the sleeve 7*c* in a direction opposite to the pickup direction. When a single mail item P is normally picked up, the sleeve 7*c* of the separation roller 7 is rotated in the pickup direction. In contrast, when two or more mail items are simultaneously picked up, the sleeve 7*c* is rotated in a direction opposite to the above, whereby the second and later mail items are returned and separated from the first mail item.

When superposed mail items P are separated and fed to the conveyance path 9 one by one, as described above, a gap is formed between the adjacent mail items P by executing on/off control of the negative pressure in the negative-pressure chamber 5, or by intermittently running the pickup belt 4. The gap is determined in accordance with the processing rate of mail items P in a processing unit (which is not shown or described) connected to the conveyance path 9 and located downstream of the feeding device 1.

Specifically, to enhance the processing efficiency of the processing unit located downstream and impart a sufficient processing time, it is desirable to control the gap between adjacent mail items to a desired length. However, in the case of the method of forming a gap by intermittently operating the pickup belt 4, it is difficult to highly accurately control the times required for accelerating and decelerating the belt, and hence slippage may occur between the belt and each mail item when the belt is accelerated or decelerated.

Further, to execute on/off control of the negative pressure in the negative-pressure chamber 5 so as to control the gap between mail items, an electromagnetic valve may be employed across a pipe connecting the pump 13 to the negative-pressure chamber 5, and be subjected to on/off control. In this method, however, much time is required to return the negative pressure in the negative-pressure chamber 5 to the atmospheric pressure, since the negative pressure in the negative-pressure chamber 5 remains for a long time even after the drawing of air by the pump 13 is stopped, where a mail item P is left on the belt. Thus, it is difficult for any one of the above methods to control the gap between adjacent mail items to a desired length.

In light of the above, the inventors of the present invention have found a method of attaching a pressure adjustment unit to the negative-pressure chamber 5, thereby positively controlling the negative pressure in the negative-pressure chamber 5 so as to set the gap between adjacent mail items to a desired length. The pressure adjustment units according to embodiments of the invention will be described.

Figure 4:
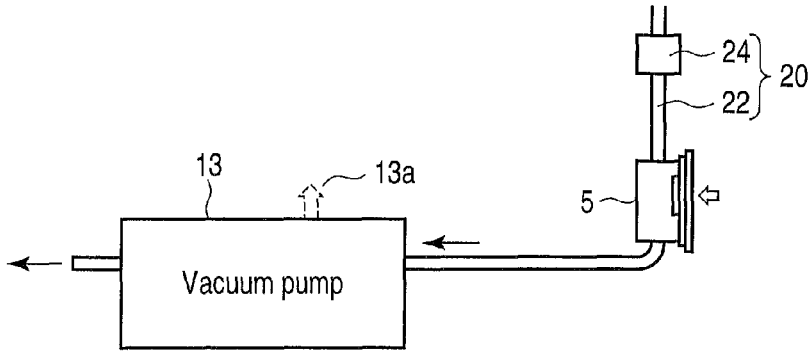
FIG. 4 is a schematic view illustrating the structure of the essential part of a mail feeding device with a pressure adjustment unit according to a first embodiment of the invention.

FIG. 4 schematically shows the essential structure of the feeding device 1 with a pressure adjustment unit 20 according to a first embodiment of the invention. The pressure adjustment unit 20 comprises a suction pipe 22 for feeding air into the negative-pressure chamber 5, and an electromagnetic valve 24 (on/off valve) provided across the suction pipe 22. The electromagnetic valve 24 is on/off controlled by the controller 10.

Thus, in the first embodiment, the pump 13 is always operated to keep, at a negative value, the internal pressure of the negative-pressure chamber 5, and the electromagnetic valve 24 is opened when no mail item P should be stuck to the pickup belt 4 by negative pressure. The suction pipe 22 has a large diameter so that when the electromagnetic valve 24 is opened, the amount of air flowing via the suction pipe 22 into the negative-pressure chamber 5, which has its internal pressure kept at a negative value by the pump 13, is much greater than the amount of air drawn by the pump 13.

Specifically, when the front end of a mail item P sticking to the pickup belt 4 and then fed to the conveyance path 9 reaches the sensor 5S, the controller 10 determines that the mail item P is transferred to the nip 8*c* of the conveyance belts 8*a* and 8*b*, and closes the electromagnetic valve 24. In the following description, this timing is referred to as the "first timing." This process enables a leading mail item P to be held by the nip 8*c* of the conveyance belts 8*a* and 8*b* and to be reliably conveyed to the downstream side, and prevents subsequent mail items from sticking to the pickup belt 4 while the leading mail item P is being held by the pickup belt 4. Namely, simultaneous pickup of two or more mail items P can be avoided.

Upon detection of the gap between the leading and subsequent mail items P, the controller 10 opens the electromagnetic valve 24 to enable the subsequent mail item P to be held by the pickup belt 4. Thus, pickup of the subsequent mail item is started. In the following description, this timing will be referred to as the "second timing." The above-mentioned gap can be controlled by adjusting the timing of opening of the electromagnetic valve 24. When one of the sensors S to S4 outputs a signal indicating "brightness," it is determined that a gap has been detected between the leading and subsequent mail items.

As described above, in the first embodiment, air is positively introduced into the negative-pressure chamber 5 via the suction pipe 22 by opening the electromagnetic valve 24 at the first timing at which no mail item sticks to the pickup belt 4. This enables negative pressure in the negative-pressure chamber 5 to quickly disappear and hence enables the gap between mail items P to be accurately set to a desired length. As a result, the pickup cycle of mail items P can be shortened, which means that high-speed pickup of mail items P can be realized.

Figure 5:
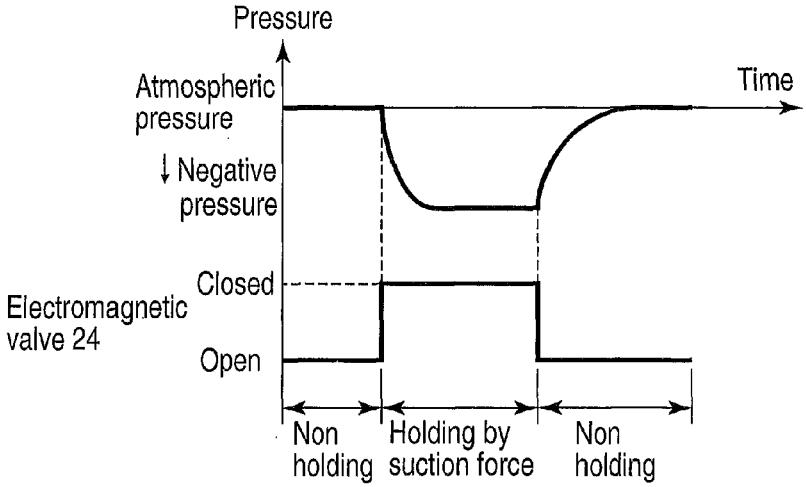
FIG. 5 is a graph illustrating variations in the internal pressure of a negative-pressure chamber that occur when the pressure adjustment unit of FIG. 4 is used.

FIG. 5 is a graph illustrating the relationship between variations in the internal pressure of the negative-pressure chamber 5 and the on/off timing of the electromagnetic valve 24 incorporated in the pressure adjustment unit 20 of the above-described first embodiment. From this graph, it is evident that the internal pressure of the negative-pressure chamber 5 is abruptly reduced immediately after the electromagnetic valve 24 is closed at the second timing. This is because the pump 13 is always operated to draw air from the negative-pressure chamber 5. The pump 13 has a release valve 13*a* (pressure valve) for preventing the internal pressure of the negative-pressure chamber 5 from excessively reducing. Accordingly, even when the pump 13 is always operated, the internal pressure of the negative-pressure chamber 5 is prevented from reducing permanently.

It is also evident from the graph of FIG. 5 that immediately after the electromagnetic valve 24 is opened at the first timing, the internal pressure of the negative-pressure chamber 5 approaches the atmospheric pressure relatively gently. This is because while the electromagnetic valve 24 is opened to flow air into the negative-pressure chamber 5, the air in the negative-pressure chamber 5 is drawn by the pump 13.

However, the internal pressure of the negative-pressure chamber 5 in the first embodiment can be increased to the atmospheric pressure more quickly than in the conventional case where an on/off valve is provided across the suction pipe of a pump. Namely, the pressure adjustment unit 20 of the embodiment can instantly increase the internal pressure of the negative-pressure chamber 5 to the atmospheric pressure even when a mail item P blocks the opening 5*a* of the chamber 5, whereby high-speed pickup of each mail item P can be realized.

Figure 6:
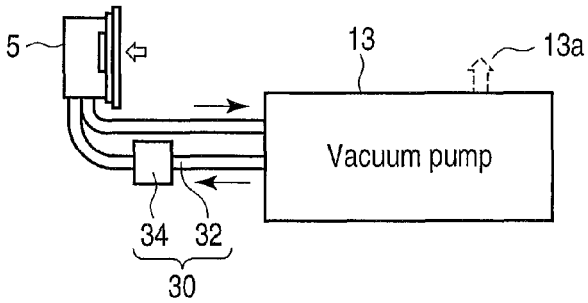
FIG. 6 is a schematic view illustrating the structure of the essential part of a mail feeding device with a pressure adjustment unit according to a second embodiment of the invention.

FIG. 6 schematically shows the essential part of a feeding device 1 with a pressure adjustment unit 30 according to a second embodiment. The feeding device 1 with the pressure adjustment unit 30 is similar in basic structure and basic operation to the feeding device 1 with the pressure adjustment unit 20 of the first embodiment, and hence elements similar to those of the first embodiment will be described in detail.

The pressure adjustment unit 30 comprises an exhaust pipe 22 connecting the exhaust port of the pump 13 for drawing air from the negative-pressure chamber 5, to the chamber 5, and an electromagnetic valve 34 (on/off valve) provided across the exhaust pipe 32. The pressure adjustment unit 30 differs from the pressure adjustment unit 20 of the first embodiment in that the former positively introduces the exhaust air of the pump 13 into the negative-pressure chamber 5.

In the second embodiment, the controller 10 executes on/off control of the electromagnetic valve 34 at the same timing as that of the electromagnetic valve 24. However, in the second embodiment, upon the opening of the electromagnetic valve 34, air is more positively introduced into the negative-pressure chamber 5 than in the first embodiment, and hence the pressure in the negative-pressure chamber 5 can be increased to the atmospheric pressure more quickly than in the first embodiment.

Figure 7:
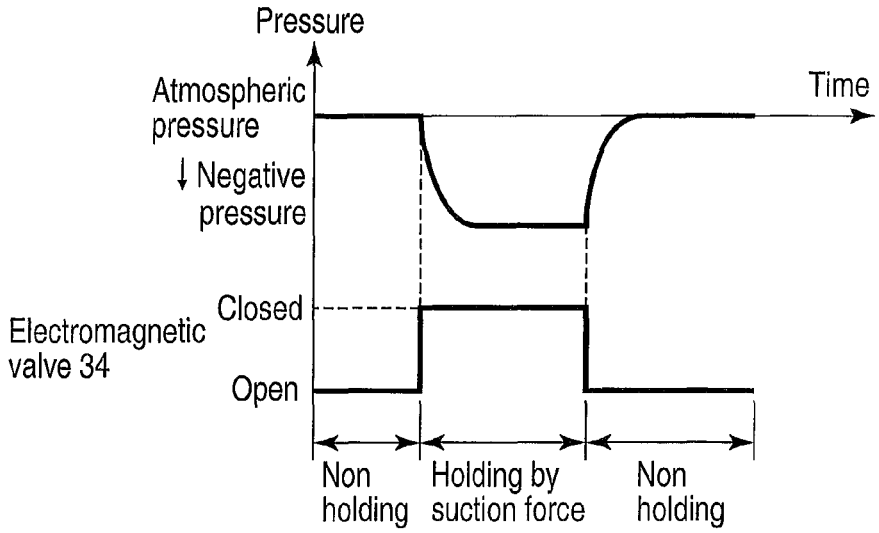
FIG. 7 is a graph illustrating variations in the internal pressure of a negative-pressure chamber that occur when the pressure adjustment unit of FIG. 6 is used.

FIG. 7 is a graph illustrating the relationship between variations in the internal pressure of the negative-pressure chamber 5 and the on/off timing of the electromagnetic valve 34 of the pressure adjustment unit 30. From this graph, it is evident that immediately after the electromagnetic valve 34 is opened, the internal pressure of the negative-pressure chamber 5 is more quickly increased to the atmospheric pressure than in the case shown in FIG. 5. Namely, in the second embodiment, the exhaust air of the pump 13 abruptly flows into the negative-pressure chamber 5 upon the opening of the electromagnetic valve 34, with the result that the pressure in the negative-pressure chamber 5 is instantly increased to the atmospheric pressure.

Figure 8:
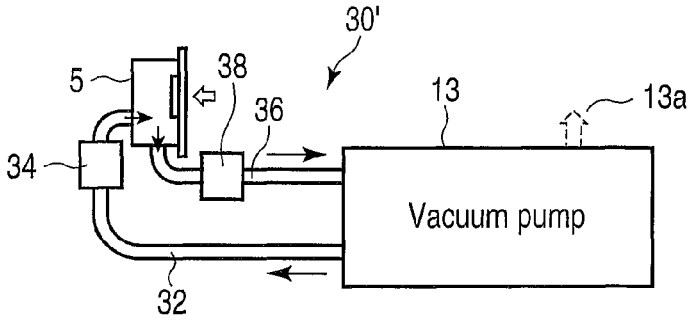
FIG. 8 is a schematic view illustrating a modification of the pressure adjustment unit of FIG. 6.

FIG. 8 shows the essential part of a feeding device 1 with a pressure adjustment unit 30' according to a modification of the above-described second embodiment. In this modification, an electromagnetic valve 38 is additionally provided across a suction pipe 36 that connects the suction port of the pump 13 to the negative-pressure chamber 5. Except for the electromagnetic valve 38 provided across the suction pipe 36, the modification has the same structure as the second embodiment. No description will be given of the similar elements.

In the modification, when picking up a mail item P, the controller 10 closes the electromagnetic valve 34 of the exhaust pipe 32 and opens the electromagnetic valve 38 of the suction pipe 36, thereby causing the pickup belt 4 to hold a mail item P by a suction force and then feeding the item to the conveyance path 9.

At first timing at which the front end of the picked mail item P reaches the nip 8*c* of the conveyance belts 8*a* and 8*b*, the controller 10 opens the electromagnetic valve 34 of the exhaust pipe 32 and closes the electromagnetic valve 38 of the suction pipe 36. As a result, the pressure in the negative-pressure chamber 5 is more quickly returned to the atmospheric pressure than in the second embodiment.

Further, at second timing at which a gap is detected between the mail item P and a subsequent one, the controller 10 closes the electromagnetic valve 34 of the exhaust pipe 32 and opens the electromagnetic valve 38 of the suction pipe 36. As a result, the air in the negative-pressure chamber 5 is instantly exhausted, and the subsequent mail item P is picked up instantly. Thus, in the modification, the two electromagnetic valves 34 and 38 are operated in opposite manners.

Figure 9:
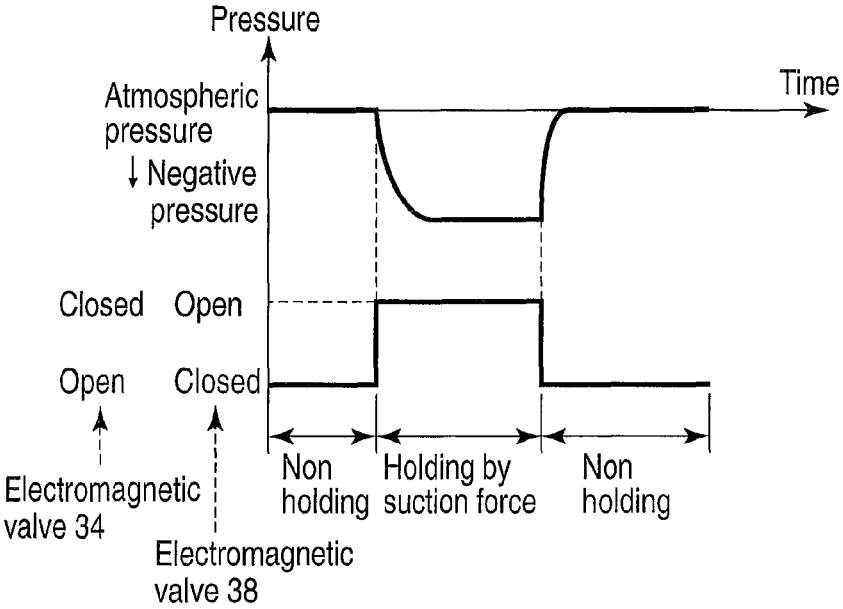
FIG. 9 is a graph illustrating variations in the internal pressure of a negative-pressure chamber that occur when the pressure adjustment unit of FIG. 8 is used.

FIG. 9 is a graph illustrating the relationship between variations in the internal pressure of the negative-pressure chamber 5 and the on/off timing of the electromagnetic valves 34 and 38 of the pressure adjustment unit 30' shown in FIG. 8. From this graph, it is evident that immediately after the electromagnetic valve 34 is opened and the electromagnetic valve 38 is closed, the internal pressure of the negative-pressure chamber 5 is more quickly increased to the atmospheric pressure than in the case shown in FIG. 7. Namely, in the case of using the pressure adjustment unit 30', the exhaust air of the pump 13 abruptly flows into the negative-pressure chamber 5 upon the opening of the electromagnetic valve 34, and the exhaustion of the air in the chamber 5 is stopped upon the closing of the electromagnetic valve 38. As a result, the pressure in the negative-pressure chamber 5 is more quickly increased to the atmospheric pressure.

Figure 10:
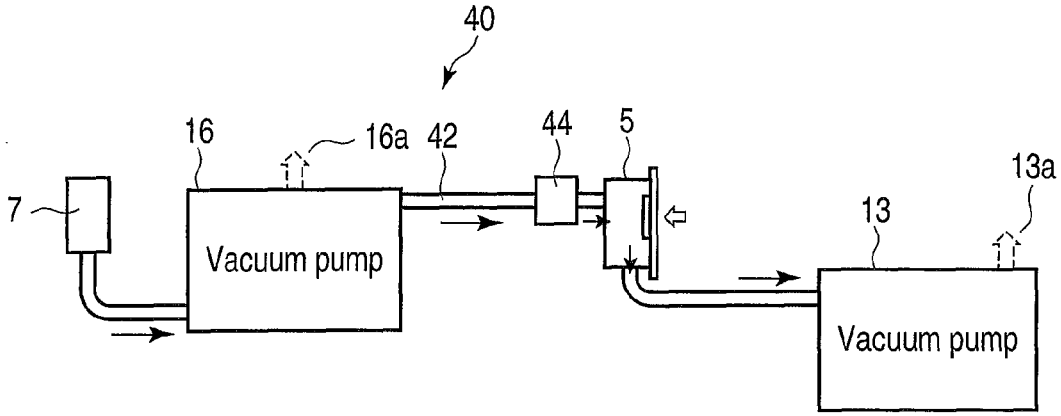
FIG. 10 is a schematic view illustrating the structure of the essential part of a mail feeding device with a pressure adjustment unit according to a third embodiment of the invention.

FIG. 10 schematically shows the essential part of a feeding device 1 with a pressure adjustment unit 40 according to a third second embodiment. The pressure adjustment unit 40 is characterized in that the exhaust air of a pump 16 is introduced into the negative-pressure chamber 5 at the above-mentioned first timing, instead of introducing the exhaust air of the pump 13 into the negative-pressure chamber 5. This point differs from the pressure adjustment unit 30 of the second embodiment shown in FIG. 6.

In particular, in the third embodiment, the exhaust air of the pump 16, which is used to draw air from the chamber 7*a* of the core 7*b*, is also used to return the internal pressure of the negative-pressure chamber 5 to the atmospheric pressure. However, the invention is not limited to this. For instance, the exhaust air of the blower 14, which is used to draw air from the suction chamber 6, may also be used to return the internal pressure of the negative-pressure chamber 5 to the atmospheric pressure. Alternatively, a dedicated air supply unit may be connected to the negative-pressure chamber 5.

When feeding a mail item P, the controller 10 of the feeding device 1 closes an electromagnetic valve 44 (on/off valve) provided across the exhaust pipe 42 of the pump 16, and causes the pump 13 to draw air from the negative-pressure chamber 5. At this time, the pump 16 for generating negative pressure around the separation roller 7 is made to continue its air drawing, and the thus-drawn air is relieved through a relief valve 16*a*.

After that, the controller 10 opens the electromagnetic valve 44 at the above-mentioned first timing to thereby introduce the exhaust air of the pump 16 into the negative-pressure chamber 5. As a result, the same advantage as in the second embodiment can be provided. Namely, at the first timing, the internal pressure of the negative-pressure chamber 5 can be returned to the atmospheric pressure as quickly as shown in FIG. 7.

Figure 11:
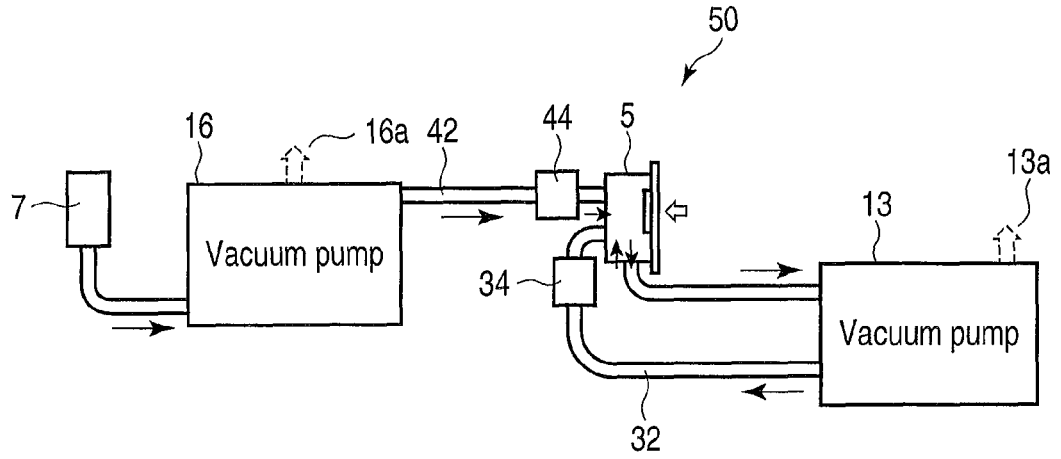
FIG. 11 is a schematic view illustrating the structure of the essential part of a mail feeding device with a pressure adjustment unit according to a fourth embodiment of the invention.

FIG. 11 schematically illustrates the structure of the essential part of a mail feeding device 1 with a pressure adjustment unit 50 according to a fourth embodiment of the invention. The pressure adjustment unit 50 has a structure obtained by combining the pressure adjustment units 30 and 40 of the second and third embodiments.

Specifically, the exhaust pipe 32 of the pump 13, which is used to draw air from the negative-pressure chamber 5, is connected to the negative-pressure chamber 5, and the electromagnetic valve 34 is provided across the exhaust pipe 32. Further, the exhaust pipe 42 of the pump 16, which is used to draw air from the separation roller 7, is connected to the negative-pressure chamber 5, and the electromagnetic valve 44 is provided across the exhaust pipe 42. It is a matter of course that also in the fourth embodiment, anther device serving as a air feeding device may be connected to the negative-pressure chamber 5, in place of the pump 16.

In the fourth embodiment, when feeding a mail item P, the controller 10 closes the two electromagnetic valves 34 and 44, causes the pump 13 to draw air from the negative-pressure chamber 5, and runs the pickup belt 4 to pick up the mail item P. After that, the controller 10 opens the two electromagnetic valves 34 and 44 at the above-mentioned first timing to instantly return the internal pressure of the negative-pressure chamber 5 to the atmospheric pressure, thereby preventing a subsequent mail item P to be held on the pickup belt 4 by a suction force.

As described above, in the fourth embodiment, the two electromagnetic valves 34 and 44 are simultaneously opened at the above-mentioned first timing to introduce a great amount of air into the negative-pressure chamber 5, whereby the internal pressure of the negative-pressure chamber 5 can be quickly returned to the atmospheric pressure.

Figure 12:
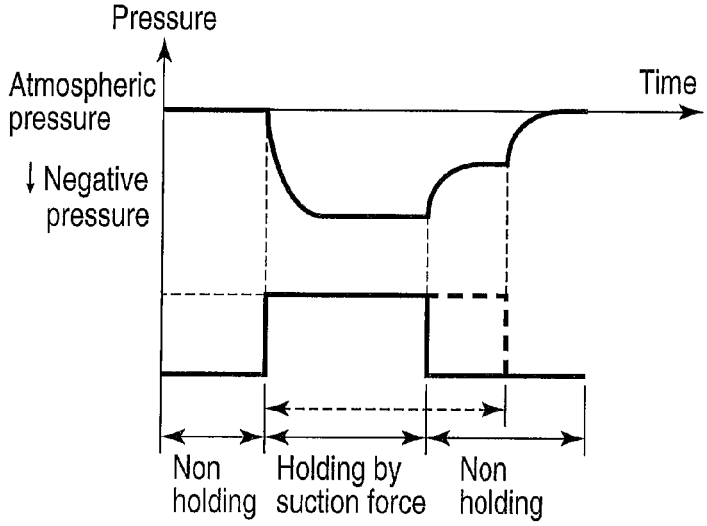
FIG. 12 is a graph illustrating variations in the internal pressure of a negative-pressure chamber that occur when the pressure adjustment unit of FIG. 11 is used.

Alternatively, the two electromagnetic valves 34 and 44 may be sequentially opened at the above-mentioned first timing. Namely, a time difference may be imparted between the times of opening the two electromagnetic valves 34 and 44. In this case, for example, the internal pressure of the negative-pressure chamber 5 can be stepwise returned to the atmospheric pressure as shown in FIG. 12.

Figure 13:
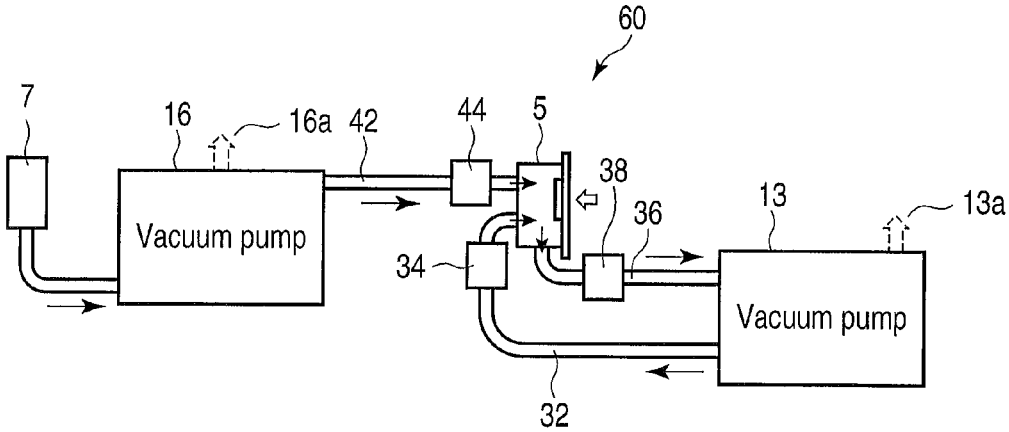
FIG. 13 is a schematic view illustrating the structure of the essential part of a mail feeding device with a pressure adjustment unit according to a fifth embodiment of the invention.

FIG. 13 schematically illustrates the structure of the essential part of a mail feeding device 1 with a pressure adjustment unit 60 according to a fifth embodiment of the invention. The pressure adjustment unit 60 has a structure obtained by adding the structure of the pressure adjustment unit 30' shown in FIG. 8 to the pressure adjustment unit 50 of the fourth embodiment.

The pressure adjustment unit 60 can instantly return the internal pressure of the negative-pressure chamber 5 to the atmospheric pressure at the first timing, and make the processing efficiency of the feeding device 1 highest. Specifically, at the first timing, the two electromagnetic valves 34 and 44 are opened, and the electromagnetic valve 38 across the suction pipe 36 of the pump 13 is closed, whereby a great amount of air can be introduced into the negative-pressure chamber 5 with the drawing of air from the chamber 5 stopped. As a result, the internal pressure of the negative-pressure chamber 5 can be instantly returned to the atmospheric pressure.

Figure 14:
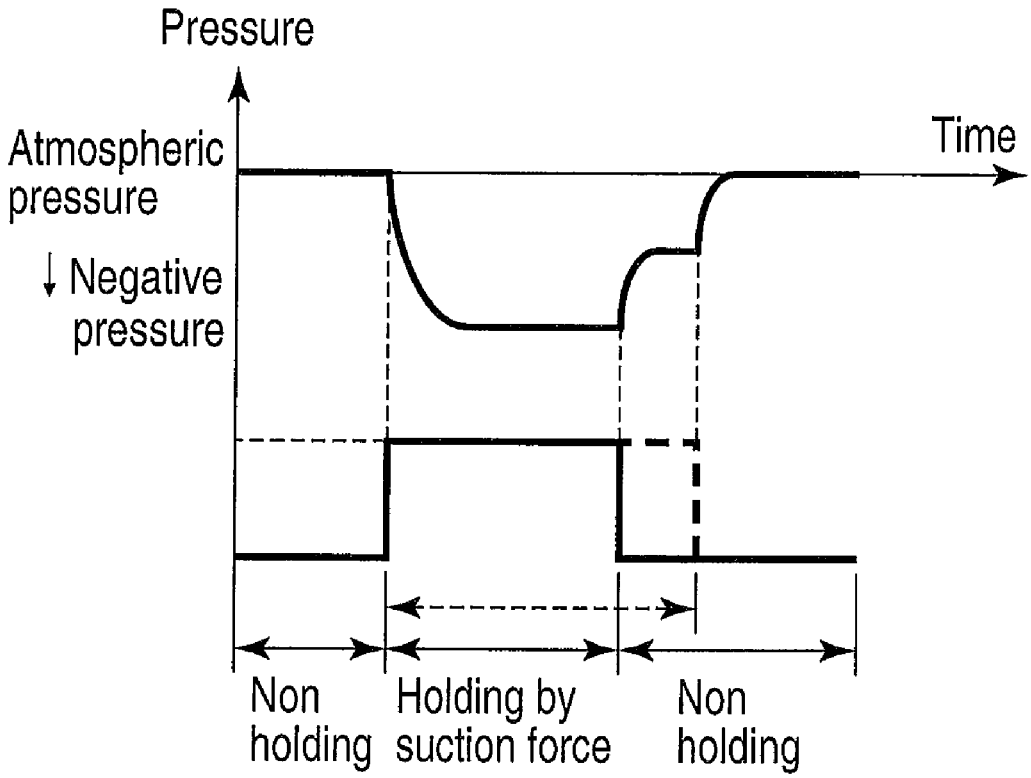
FIG. 14 is a graph illustrating variations in the internal pressure of a negative-pressure chamber that occur when the pressure adjustment unit of FIG. 13 is used.

FIG. 14 is a graph illustrating variations in the internal pressure of the negative-pressure chamber 5 that occur when the pressure adjustment unit 60 is used. Also in the fifth embodiment, the two electromagnetic valves 34 and 44 can be sequentially opened at the first timing, and hence the degree of freedom of use of the feeding device 1 is high, as in the fourth embodiment. Yet further, it can be understood from FIGS. 12 and 14 that when the two electromagnetic valves 34 and 44 are stepwise opened at the first timing, the internal pressure of the negative-pressure chamber 5 of the fifth embodiment can be more quickly returned to the atmospheric pressure than that of the fourth embodiment. This is because in the fifth embodiment, when the two electromagnetic valves 34 and 44 are opened, the suction-side electromagnetic valve 38 is closed.

As described above, in the invention, when negative pressure applied to the pickup belt 4 is eliminated to stop holding of a mail item P, air is positively introduced into the negative-pressure chamber 5, thereby instantly eliminating the negative pressure. Accordingly, the invention is free from an undesired phenomenon in which the negative pressure cannot completely be eliminated and the pickup belt 4 undesirably holds a subsequently mail item by the remaining negative pressure. In the invention, each mail item P can be held by the pickup belt 4 at desired timing, and hence the pickup cycle of mail items P can be shortened and a reliable gap can be set between subsequent mail items P.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For instance, in the above-described fourth and fifth embodiments, at the first timing, the exhaust air of the pump 13, which is used to draw air from the negative-pressure chamber 5, is returned into the chamber 5, and air is further fed into the chamber through another air feeding device (e.g., the pump 16) connected to the chamber 5. However, the invention is not limited to this structure. Yet another air feeding device may be connected to the chamber 5 to feed a greater amount of air into the same.

In addition, although the above-described embodiments employ the endless pickup belt 4 as a pickup member for picking up each mail item P supplied to the pickup position S, another type of pickup member may be used. For example, this pickup member may be formed of a rotor with a plurality of suction holes that rotates in a direction in which the mail items are picked up.

What is claimed is:

1. A mail feeding device comprising:

a pickup member including a suction hole formed therein, and configured to run along one of accumulated mail items in a direction in which the one mail item is picked up, the one mail item being accumulated earliest and positioned at a pickup position;

a negative-pressure chamber including an opening which opposes the pickup position with the pickup member interposed therebetween, the negative-pressure chamber applying negative pressure, via the suction hole, to the one mail item positioned at the pickup position, thereby making the one mail item to be held by the pickup member;

a drawing unit which draws air from the negative-pressure chamber;

a pressure adjustment unit configured to introduce air into the negative-pressure chamber, from which air was drawn by the drawing unit, to increase internal pressure of the negative-pressure chamber toward atmospheric pressure;

a conveyance section configured to receive the one mail item held on the pickup member by the negative pressure and picked up from the pickup position, and to convey the picked up mail item;

a detector section configured to detect whether the picked up mail item has been transferred to the conveyance section; and a controller configured to cause the pressure adjustment unit to increase the internal pressure of the negative-pressure chamber toward atmospheric pressure after the detector section detects that the picked up mail item has been transferred to the conveyance section, wherein the pressure adjustment unit includes an exhaust pipe which connects an exhaust port of the drawing unit to the negative-pressure chamber, and an on/off valve provided across the exhaust pipe, the controller executing on/off control of the on/off valve.

2. The mail feeding device according to claim 1, wherein the pressure adjustment unit includes an on/off valve provided across a suction pipe which connects a suction port of the drawing unit to the negative-pressure chamber, and the controller executes on/off control of the on/off valve of the exhaust pipe and the on/off valve of the suction pipe.

3. The mail feeding device according to claim 2, wherein the controller executes on/off control of the two on/off valves such that the on/off valve of the suction pipe is opened with the on/off valve of the exhaust pipe closed, and the on/off valve of the suction pipe is closed with the on/off valve of the exhaust pipe kept open.

4. A mail feeding device comprising:

a pickup member including a suction hole formed therein, and configured to run along one of accumulated mail items in a direction in which the one mail item is picked up, the one mail item being accumulated earliest and positioned at a pickup position;

a negative-pressure chamber including an opening which opposes the pickup position with the pickup member interposed therebetween, the negative-pressure chamber applying negative pressure, via the suction hole, to the one mail item positioned at the pickup position, thereby making the one mail item to be held by the pickup member;

a first drawing unit which draws air from the negative-pressure chamber;

a pressure adjustment unit configured to introduce air into the negative-pressure chamber, from which air was drawn by the drawing unit, to increase internal pressure of the negative-pressure chamber toward atmospheric pressure;

a conveyance section configured to receive the one mail item held on the pickup member by the negative pressure and picked up from the pickup position, and to convey the picked up mail item;

a detector section configured to detect whether the picked up mail item has been transferred to the conveyance section;

a controller configured to cause the pressure adjustment unit to increase the internal pressure of the negative-pressure chamber toward atmospheric pressure after the detector section detects that the picked up mail item has been transferred to the conveyance section; and a separation unit configured to apply negative pressure to at least one mail item picked up unintentionally simultaneously with the one mail item held on the pickup member by the negative pressure of the negative-pressure chamber and picked up from the pickup position, wherein the pressure adjustment unit includes an exhaust pipe which connects an exhaust port of a second drawing unit which generates negative pressure via the separation unit to the negative-pressure chamber, and an on/off valve provided across the exhaust pipe, the controller executing on/off control the on/off valve.

5. The mail feeding device according to claim 4, wherein the pressure adjustment unit further includes an on/off valve provided across a suction pipe which connects a suction port of the first drawing unit to the negative-pressure chamber, and the controller executes on/off control of the on/off valve provided across the exhaust pipe, and the on/off valve provided across the suction pipe.

* * * * *